US005714117A

United States Patent [19]

Berge et al.

[11] Patent Number: 5,714,117

[45] Date of Patent: Feb. 3, 1998

[54] AIR MELTING OF CU-CR ALLOYS

[75] Inventors: Paul M. Berge; Edwin D. Gibson, both of Ames; Seong-Tcho Kim, Cedar Rapids; John D. Verhoeven, Ames, all of Iowa

[73] Assignee: Iowa State University Research Foundation, Inc., Ames, Iowa

[21] Appl. No.: 594,158

[22] Filed: Jan. 31, 1996

[51] Int. Cl.[6] ..... C22C 1/03

[52] U.S. Cl. ..... 420/587; 420/495; 420/590

[58] Field of Search ..... 420/590, 495, 420/587; 266/207, 216; 373/142, 146; 75/10.14, 652

[56] References Cited

U.S. PATENT DOCUMENTS

| | | | |
|---|---|---|---|
| 2,025,662 | 12/1935 | Hensel et al. | 420/495 |
| 5,364,449 | 11/1994 | NaKamura et al. | 75/652 |
| 5,480,472 | 1/1996 | Noda et al. | 420/590 |

FOREIGN PATENT DOCUMENTS

| | | | |
|---|---|---|---|
| 309781 | 4/1989 | European Pat. Off. | 266/216 |
| 3716401 | 10/1962 | Japan | 75/10.14 |
| 582 236 | 11/1946 | United Kingdom . | |

OTHER PUBLICATIONS

Copper–Refractory Metal Alloys; J. of Metals, Sep., 1986, pp. 20–24, Verhoeven, et al.

*Primary Examiner*—Melvyn Andrews
*Attorney, Agent, or Firm*—Edward J. Timmer

[57] ABSTRACT

Method and apparatus for making a Cu-Cr melt involves melting Cu-bearing alloy component in a melting vessel disposed in ambient air atmosphere, retaining Cr-bearing alloy component in an inverted ceramic crucible held submerged in the melted Cu-bearing alloy component, introducing inert gas into the melted Cu-bearing alloy component, and flowing the melted Cu-bearing alloy component in the melting vessel through openings in the submerged crucible to contact the Cr-bearing alloy component.

7 Claims, 3 Drawing Sheets

AIR MELTING OF CU-CR ALLOYS

FIELD OF THE INVENTION

The present invention relates to the melting of Cu-Cr alloys and, more particularly, to the air melting of Cu-Cr alloys having relatively high Cr levels, such as, for example, greater than about 5 weight % Cr, without harmful oxidation of the Cr alloy component.

BACKGROUND OF THE INVENTION

Copper-chromium alloys are used in a wide variety of applications by virtue of their excellent combination of strength and both electrical and thermal conductivity. Commercial Cu-Cr alloys known as chromium coppers are designated C18200, C18400, and C18500. These alloys have relatively low Cr levels between 0.4 to 1.2 weight % Cr.

The copper-chromium binary phase equilibria displays nearly complete immiscibility in the solid state between face centered cubic (fcc) Cu and the body centered cubic (bcc) chromium. A eutectic occurs at a composition of 1.28 weight % Cr with a maximum solubility of Cr in Cu of 0.65 weight % Cr occurring at the eutectic temperature of 1076 degrees C. As the temperature decreases, the solubility of Cr in Cu falls to the ppm (parts per million) range at room temperature. Consequently, the Cu matrix is essentially pure Cu and possesses the characteristic high conductivity of pure Cu. Because of the decreasing solubility of Cr in Cu, the chromium coppers can be strengthened by precipitation harding. The precipitate phase at maximum strength comprises pure Cr present in amounts that do not degrade the conductivity of the pure Cu matrix to nearly the same extent as precipitate phases formed in other precipitation hardened Cu alloys. The highest strength chromium coppers are strengthened by a combination of precipitation hardening and mechanical deformation.

Small improvements in the strength/conductivity properties of the chromium coppers have been obtained by adding small amounts of one or more additional selected alloying elements in response to interest in the semiconductor industry to develop the chromium coppers with higher strength for lead frames. FIG. 1 is a graph of ultimate tensile strength (UTS) versus electrical conductivity (%IACS) for the commercial chromium copper C18400 (single data point) versus other chromium coppers (lower line). It is apparent that a small improvement in strength is achieved with the alloyed chromium coppers (lower line).

As set forth in copending applications Ser. Nos. 07/536 706 and 07/697 762 of common assignee herewith, deformation processed Cu-Cr alloys having about 5 to 20 weight % Cr have been developed having superior combinations of strength and conductivity over the commerical chromium coppers. For example, for comparison purposes, ultimate tensile strength versus electrical conductivity properties for a deformation processed Cu-7 volume % Cr are presented in FIG. 1 in the upper line. It is apparent that significant improvements in combined strength and conductivity are achieved over the chromium coppers.

The production of the aforementioned chromium coppers begins with the manufacture of a Cu-Cr ingot. The commerical chromium copper alloys have a maximum Cr content generally around 0.8 weight % Cr. Ingots of these alloys are made using a master alloy of approximately Cu-5 weight % Cr which is diluted down to the Cr level during air melting. It would be desirable to make the master alloy with higher Cr levels but difficulty is encountered with oxidation of Cr in the air melting of higher Cr alloys.

The production of the aforementioned deformation processed Cu-Cr alloys also begins with the manufacture of a Cu-Cr ingot. The Cu-7 volume % Cr alloy whose properties are set forth in FIG. 1 was melted by vacuum induction melting (VIM) in which oxidation of the Cr alloy component is avoided by vacuum in the melting chamber and inert gas in the casting chamber.

An object of the present invention is to provide apparatus and method for making air melted Cu-Cr alloys with relatively high levels of Cr, such as, for example, greater than about 5 weight % Cr, in a manner that avoids substantial unwanted oxidation of the Cr alloy component.

Another object of the present invention is to provide apparatus and method for making air melted Cu-Cr alloy ingots with relatively high levels of Cr in a manner that the cast ingot is generally equivalent in composition and workability to a VIM ingot.

Still another object of the present invention is to provide apparatus and method for making air melted Cu-Cr alloys with relatively high levels of Cr in a manner that the cast ingot can be deformation processed to achieve combinations of strength and conductivity properties generally equivalent to those achievable with deformation processed VIM melted ingots of like composition.

SUMMARY OF THE INVENTION

The present invention provides apparatus and method for air melting Cu-Cr alloys with relatively high levels of Cr, such as, for example, greater than about 5 weight % Cr, without harmful oxidation of the Cr alloy component. One apparatus embodiment of the present invention includes a first melting vessel for receiving Cu-bearing alloy component and means for melting the Cu-bearing alloy component in the first vessel with an ambient air atmosphere about the melting vessel; i.e. without a relative vacuum present about the melting vessel. A second vessel for receving Cr-bearing alloy component therein is disposed in the first vessel so as to be submerged in the melted Cu-bearing alloy component therein. Means is provided for communicating the melted Cu-bearing alloy component in the first vessel to the Cr-bearing alloy component in the second vessel. Preferably, the apparatus further optionally includes means for introducing an inert gas to the melted Cu-bearing alloy component.

In one particular embodiment of the invention for air melting a Cu-Cr alloy having relatively high Cr content, the apparatus includes a melting vessel having a chamber for receiving Cu-bearing alloy component, induction coil means about the melting vessel for melting the Cu-bearing alloy component in the melting vessel with an ambient air atmosphere about the melting vessel, and an inert gas supply means for introducing inert gas to the melted Cu-bearing alloy component. A ceramic crucible for receiving Cr-bearing alloy component therein is disposed in the chamber of the melting vessel with an open end of the crucible held on a bottom of the melting vessel so as to submerge the crucible and the Cr-bearing alloy component in the melted Cu-bearing alloy component. The crucible includes a side or other wall with one or more openings therein for communicating melted Cu-bearing alloy component to the Cr-bearing alloy component in the crucible.

One method embodiment of the invention for air melting a Cu-Cr alloy melt involves melting Cu-bearing alloy component in a first vessel with an ambient air atmosphere about the melting vessel, retaining Cr-bearing alloy component in a second vessel submerged in the melted Cu-bearing alloy component, and communicating the melted Cu-bearing alloy component in the first vessel to the Cr-bearing alloy component in the vessel. Inert gas can be introduced to the melted Cu-bearing alloy component.

A particular method embodiment of the invention involves melting Cu-bearing alloy component in a melting vessel with an ambient air atmosphere about the melting vessel, retaining Cr-bearing alloy component in an inverted ceramic crucible submerged in the melted Cu-bearing alloy component with a crucible open end held on the bottom of the melting vessel, introducing inert gas into the melted Cu-bearing alloy component, and flowing the melted Cu-bearing alloy component in the melting vessel through openings in the crucible to contact the Cr-bearing alloy component.

The present invention is advantageous for producing air melted Cu-Cr alloy ingots with relatively high levels of Cr in a manner that the cast ingot is generally equivalent in composition and workability to a VIM Cu-Cr alloy ingot. The concentration of oxygen in the air melted ingot pursuant to the invention is comparable to that present in VIM melted ingot. Further, the present invention is advantageous for producing air melted Cu-Cr alloys with relatively high levels of Cr in a manner that the cast ingot can be deformation processed to achieve combinations of strength and conductivity properties generally equivalent to VIM melted-deformation processed ingots of like composition.

The above-mentioned objects and advantages of the present invention will be more readily understood with reference to the following detailed description of the invention taken with the following drawings.

DESCRIPTION OF THE INVENTION

Figure 2:
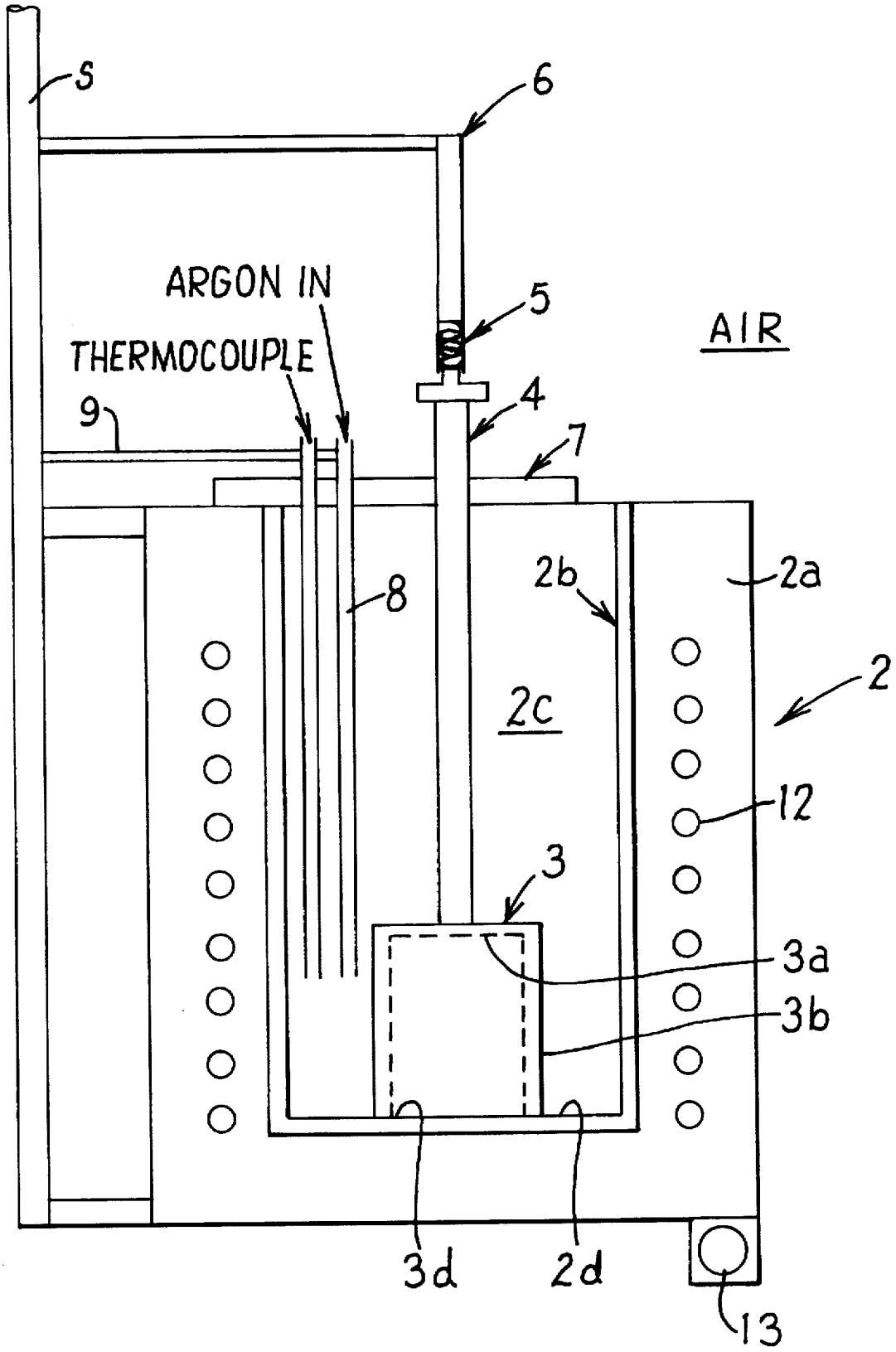
FIG. 2 is a schematic diagram of a furnace melting apparatus pursuant to the invention.
Figure 3:
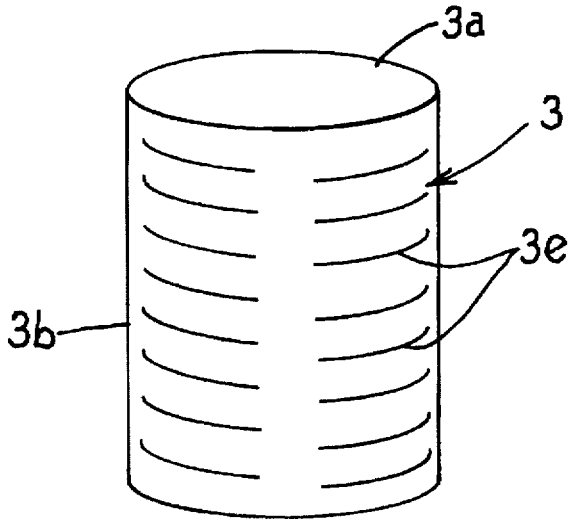
FIG. 3 is a schematic perspective diagram of the Cr-holding crucible having peripheral slots for communicating the Cu melt and Cr alloy component.

Referring to FIGS. 2–3, apparatus in accordance with one embodiment of the invention for air melting a Cu-Cr alloy is illustrated. The apparatus is useful for air melting Cu-Cr alloys with relatively high levels of Cr, such as, for example, greater than about 5 weight % Cr, without substantial harmful oxidation of the Cr alloy component. The apparatus comprises a melting vessel 2 having an outer furnace housing 2*a* comprising insulating material and a furnace crucible 2*b* having a chamber 2*c* for receiving Cu-bearing alloy component. The furnace crucible 2*b* typically comprises aluminum oxide refractory lining in the furnace housing, although the invention is not limited to any particular refractory material for the furnace crucible. A copper charge which typically comprises pure Cu is received in the chamber 2*c*.

The apparatus also comprises an inverted ceramic crucible 3 disposed in the melting vessel 2. In particular, the ceramic crucible 3 includes an end wall 3*a* and peripheral sidewall 3*b* that define a chamber in which the Cr-bearing alloy component is received. For example, a pure or alloyed chromium charge which typically comprises pure Cr pieces having dimensions of ½ to 1 inch pieces are retained in the crucible 3. The crucible 3 includes an open end 3*d* that is positioned on the bottom 2*d* of the furnace crucible 2*b*. The crucible 3 typically comprises alumina ceramic, although the invention is not limited to any particular refractory for the crucible 3. The crucible 3 is shown held with its open end 3*d* on the bottom 2*d* by a hold-down rod 4 which is spring biased by coil spring 5 to maintain the open end 3*d* against the bottom 2*d* of the furnace crucible 2*b*. The spring 5 is disposed between the hold-down rod 4 and a rod support 6 of support structure S.

As shown, the crucible 3 is disposed proximate the bottom 2*d* of the furnace crucible 2*b* such that the Cr-bearing alloy component therein is disposed and retained below the level of Cu-bearing alloy component in the melting vessel 2. Confinement of the Cr-bearing alloy component in the crucible 3 submerged in the Cu-bearing melt overcomes the the tendency of the Cr-bearing alloy component to otherwise float on the melted Cu alloy component and acumulate toward the outer periphery of the melt surface where it is heated to higher temperatures by induction coupling and more readily oxidized. The crucible 3 includes a plurality of circumferentially extending, axially spaced apart slots 3*e* or other openings through the sidewall 3*b* through which melted Cu-bearing alloy component is communicated to the Cr-bearing alloy component to contact same, FIG. 3.

A lid 7 is provided on the melting vessel 2 and covers about 80% of the opening area to help in control of the gas content in the crucible 2*b*. An argon or other inert gas supply line or conduit 8 is disposed by a line or conduit support structure 9 in the crucible 2*b* to introduce inert gas into the melted Cu-bearing alloy component. The supply line or conduit 8 is connected to a conventional gas cylinder (not shown) or source of argon or other inert gas.

An induction coil 12 is disposed in the furnace housing 2*a* about the furnace crucible 2*b* for heating the Cu-bearing alloy component to above its melting temperaure with an ambient air atmosphere AIR about the melting vessel and with argon or other inert gas preferably introduced into the furnace crucible 2*b*. Once the Cu-bearing alloy component is melted, it flows through the slots 3*e* and begins to dissolve the Cr-bearing alloy component in the crucible 3. The convective fluid (melt) flow arising from natural convection and from the forced convection of the energized induction coil 12 produces sufficient flow of the melted Cu-bearing alloy component through the crucible 3 to dissolve the Cr-bearing alloy component in fairly short times.

For example, 18 pounds of pure Cu in the furnace crucible 2*b* were heated to a maximum temperature of 1600 degrees C. for 10 minutes by energization of the induction coil 12. Argon was introduced via line or conduit 8 into the Cu melt at 0.2–0.5 scfm. Pure Cr pieces having ½ to 1 inch dimensions were retained in an alumina crucible 3 submerged in the pure Cu melt and dissolved in the Cu melt during this time to produce a Cu-7 volume % Cr melt. The Cr pieces are initially placed in the crucible 3. Melt temperatures of 1400 degrees C. and above are used in order to increase the otherwise relatively slow kinetics of the dissolution of Cr in the Cu melt.

The temperature of the Cu melt then was lowered to 1450 degrees C., and the Cu-Cr alloy melt was poured from the furnace crucible 2*b* into a heated (1000 degrees C.) holding cup (not shown) by rotation of the melting vessel 2 about the trunnion or bearing 13. The heated holding cup was disposed in AIR adjacent the melting vessel 2. The Cu-Cr alloy melt drained from the heated holding cup into a water cooled chill mold (not shown) disposed in AIR to produce a cylindrical ingots having dimensions of 4 inch diameter and approximately 5 inches length.

In lieu of tilting the melting vessel 2 to pour the Cu-Cr melt, the melting vessel 2 could be provided with a drain hole (not shown) in the bottom 2*d* and a drain hole plug (not shown) whose position is controlled by a hold-down rod similar to rod 4 to control melt pouring. The invention is not limited to any particular melt pouring technique.

Figure 1:
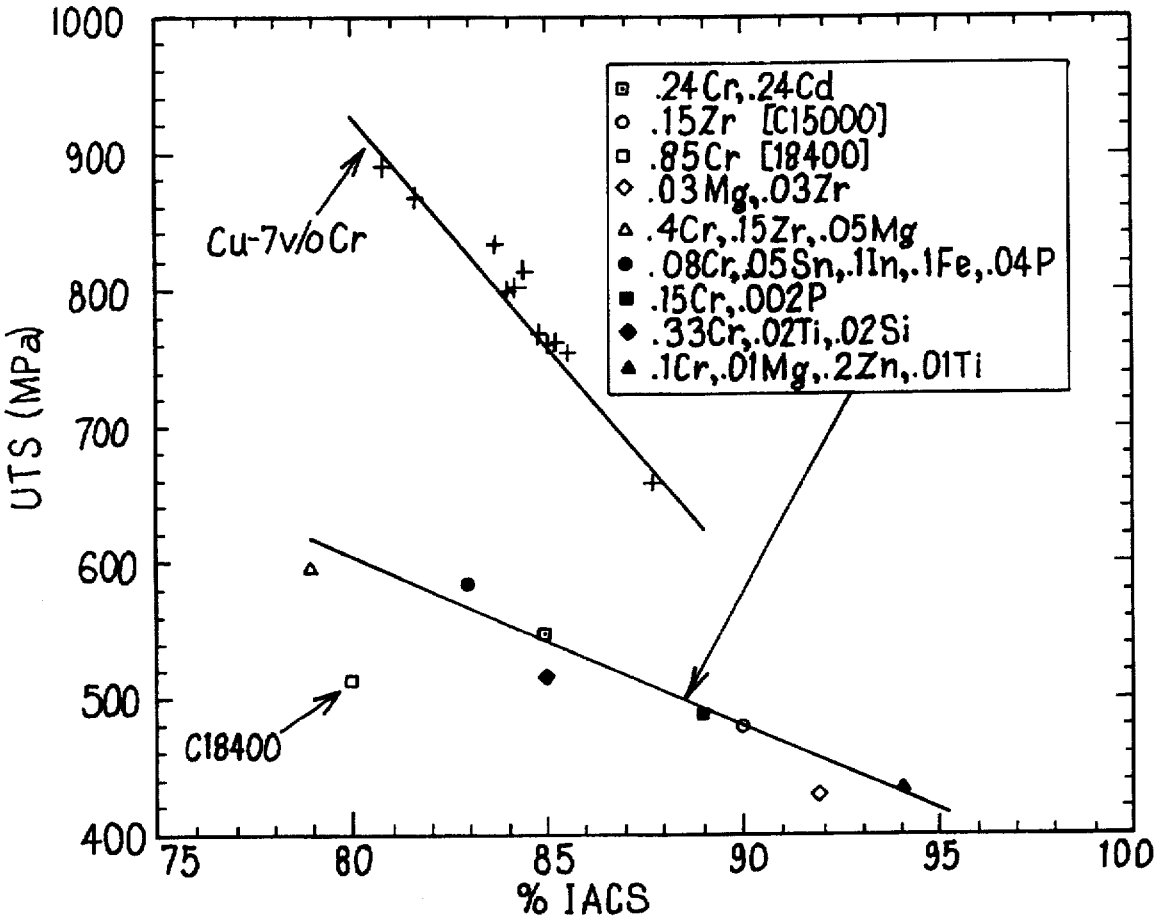
FIG. 1 is a graph of ultimate tensile strength (UTS) versus electrical conductivity for chromium coppers and for deformation processed Cu-Cr alloy ingots VIM melted and inert gas cast.

In order to evaluate the quality of the Cu-7 volume % Cr ingots produced by the air melting and casting sequence described hereabove, the ingots were reduced to wire and heat treated to determine if physical properties were similar to those exhibited by Cu-7 volume % Cr of FIG. 1 (i.e. VIM melted, inert gas cast and deformation processed material). The same deformation processing and heat treat parameters were used to produce wire from the air melted and cast specimens as were used to produce the wire exhibting the properties shown in FIG. 1.

The 4 inch diameter air melted and cast ingots were initially sealed in a copper can by electron beam welding, and the can was then hot extruded from 700 degrees C. to a diameter of 1 inch. The 1 inch extruded rod was heated to 1000 degrees C. for 10 minutes and water quenched. It was then drawn to 0.1 inch diameter wire, and the wire again heated to 1000 degrees C. for 10 minutes and water quenched. The wire was then drawn further down to 0.028 inch diameter and heated to 500 degrees C. for 6 hours followed by drawing to 0.009 inches.

Figure 4:
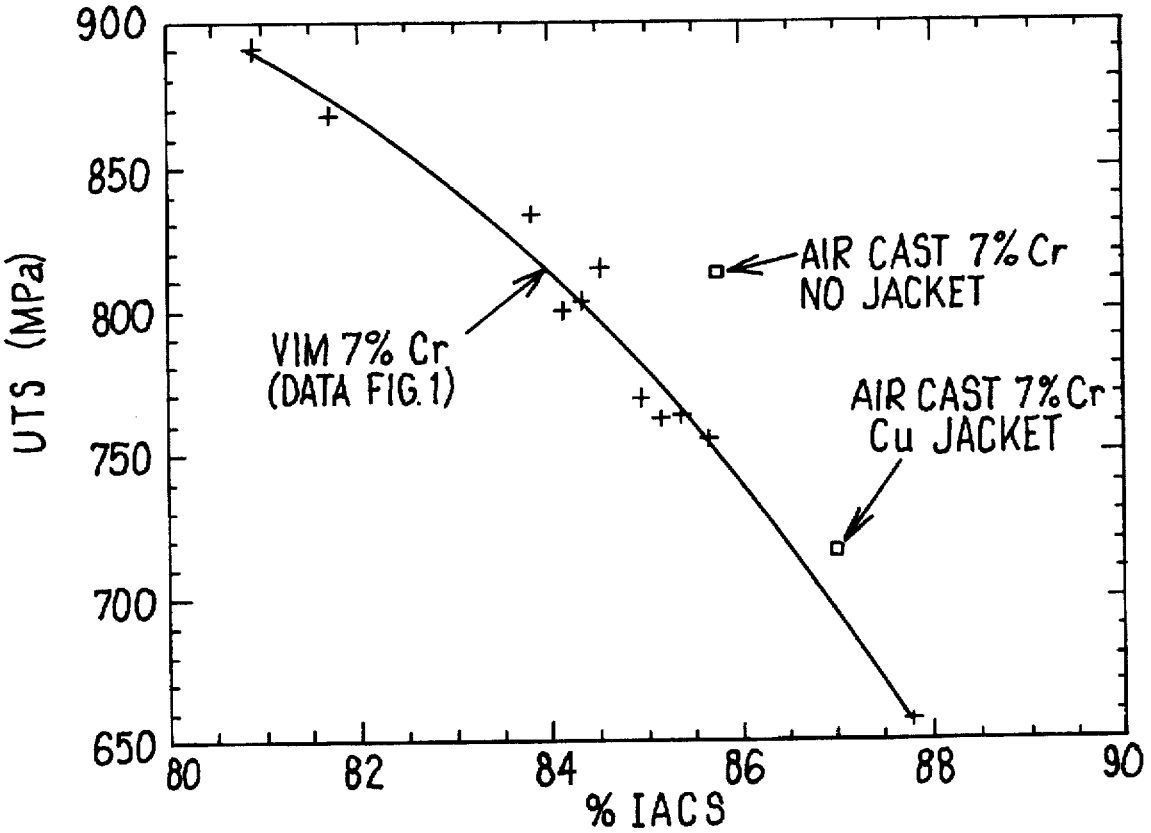
FIG. 4 is a graph of ultimate tensile strength (UTS) versus electrical conductivity for deformation processed Cu-Cr alloy ingots made by air melting and casting compared to deformation processed Cu-Cr alloy ingots made by VIM melting and inert gas casting.

The ultimate tensile strength and electrical conductivity of the wire (0.009 inch diameter) were determined and plotted in FIG. 4 with the designation "Cu Jacket" It is apparent that the ultimate tensile strength and electrical conductivity of the wire produced by the aforementioned deformation processing of air melted and cast ingots compares favorably with those of wire produced by like deformation processing of VIM melted and inert gas cast ingots (deformation processed without sealing the ingot in a Cu can).

A further comparison was made by deformation processing the air melted and cast ingots with the Cu can removed from the drawn rod at a diameter of 0.5 inch in the above-described deformation processing schedule. The ultimate tensile strength and electrical conductivity exhibited by the wire produced without the Cu can are shown n FIG. 4 with the designation "No Jacket". It is apparent that the ultimate tensile strength and electrical conductivity of the wire produced by the aforementioned deformation processing of air melted and cast ingots sans Cu can also compares favorably with those of wire produced by like deformation processing of VIM melted and inert gas cast ingots sans Cu can. These results indicate that the air melting and casting of the Cu-Cr alloy ingots pursuant to the invention produces ingots that are generally equivalent to those produced by VIM melting and inert gas casting. For example, if the air melting method of the invention were producing oxidation of the Cr alloy component or inhomogeniety of the melt, then this would be evidenced as an inability to draw the wire to the large degree set forth hereabove without breakage. However, breakage was not a problem in the aforementioned deformation processing the air melted and cast ingots as described hereabove. The generally equivalent physical properties of FIG. 4 also are indicative that air melting and casting produced the same ingot microstructure as the VIM melting technique. In addition, the deformation processed wire from the air melted and cast ingots was sectioned and metallographically examined. No evidence of oxide inclusions was found in the microstructure, which was comparable to that obtained by VIM melting/inert gas casting followed by deformation processing.

For further confirmation, a piece was cut from an air melted and cast ingot made pursuant to the invention (prior to deformation processing) and was chemically analyzed by combustion analysis for interstitial atoms C, N and O. The levels of impurities found were C=20 ppm, O=232 ppm, and N=15 ppm. These levels are quite low and comparable to those determined for VIM melted and inert gas cast ingots. Hence, air melting and casting of the Cu-7 volume % Cr was conducted without harmful contamination of the melt.

The air melting apparatus and method of the invention can be used in preparing Cu-Cr alloy ingots having relatively high Cr levels, such as about 5 to about 20 weight % Cr, with ingot composition and workability comparable to VIM melted and inert gas cast ingots. The invention can be used to air melt Cu-Cr alloys for a wide variety of purposes; for example, in the preparation of master alloys used in the manufacture of chromium coppers, such as C18400 alloys, and for making ingots to be deformation processed or otherwise worked to shape.

Although the invention has been described with respect to certain embodiments thereof for purposes of illustration, those skilled in the art will appreciate that the embodiments can be modified and changed within the scope of the invention as set forth in appended claims.

We claim:

1. Method of making a Cu-Cr melt, comprising;

melting Cu-bearing alloy component in a first melting vessel with an ambient air atmopshere about the melting vessel, retaining Cr-bearing alloy component in a second vessel submerged in the melted Cu-bearing alloy component, and communicating the melted Cu-bearing alloy component in said first vessel to the Cr-bearing alloy component in the second vessel.

2. The method of claim 1 further including introducing an inert gas to the melted cu-bearing alloy component.

3. The method of claim 1 wherein the second vessel is held submerged in the melted Cu-bearing alloy component.

4. The method of claim 1 wherein the melted Cu-bearing component and the Cr-bearing alloy component are communicated by flowing the melted Cu-bearing alloy component into the second vessel through an opening therein.

5. Method of making a Cu-Cr melt, comprising;

melting Cu-bearing alloy component in a melting vessel with an ambient air atmosphere about the melting vessel, retaining Cr-bearing alloy component in an inverted ceramic crucible submerged in the melted Cu-bearing alloy component, and introducing inert gas into the melted Cu-bearing alloy component, and flowing the melted Cu-bearing alloy component in said melting vessel into the crucible to contact the Cr-bearing alloy component.

6. The method of claim 5 wherein the melted Cu-bearing component is flowed through an opening in said crucible to contact the Cr-bearing alloy component.

7. The method of claim 5 including holding an open end of the crucible on a bottom of said melting vessel while the Cu-bearing alloy component is melted.

* * * * *